United States Patent [19]

Bingham

[11] 4,098,529

[45] Jul. 4, 1978

[54] AUTOMOBILE DOOR LOCK

[76] Inventor: Richard Bingham, 2549 W. Eastwood, Chicago, Ill. 60625

[21] Appl. No.: 811,777

[22] Filed: Jun. 30, 1977

[51] Int. Cl.[2] ..... E05C 19/00

[52] U.S. Cl. ..... 292/1; 70/181; 292/347

[58] Field of Search ..... 70/237, DIG. 56, 333 R, 70/439, DIG. 43, 181; 16/110 R; 292/347, DIG. 2, 1

[56] References Cited

U.S. PATENT DOCUMENTS

| | | | |
|---|---|---|---|
| 2,708,845 | 5/1955 | Trammell | 70/181 |
| 2,853,332 | 9/1958 | Skutnik | 292/347 |
| 3,501,187 | 3/1970 | Saksa et al. | 292/347 X |
| 3,623,758 | 11/1971 | Trinca | 292/347 |
| 3,915,485 | 10/1975 | Richman et al. | 292/347 X |
| 3,999,788 | 12/1976 | Livingston | 292/DIG. 2 |

*Primary Examiner*—Louis K. Rimrodt
*Attorney, Agent, or Firm*—James P. Hume

[57] ABSTRACT

A collar of suitable material, such as rubber, plastic, wood, metal, or the like, placed in surrounding association with a locking handle of an automobile door, of the type which extend vertically upwardly from the inside of the window sill of the door and which has an enlargement or knob at its upper end, the collar serving to convert such handle, when it is in "locked-door" position, to one having a side wall configuration of substantially uniform diameter throughout its height, such collar having an inside diameter smaller than the diameter of the enlarged head or end knob of such handle, but sufficiently large to slidably accommodate the shank of such handle and having an upper annular surface shaped to conform to the underside of the enlarged head of such handle. The collar and resulting modified handle serving to prevent the capability of such handle being lifted by means of a hooked wire, or the like, projected into the interior of the automobile through the space between the door window glass and the portion of the automobile framing the window glass, and hooked beneath the enlarged knob-like end of such handle so as to unlock the door.

2 Claims, 4 Drawing Figures

AUTOMOBILE DOOR LOCK

BACKGROUND OF THE INVENTION

Most automobiles manufactured today, as well as the great majority of those in use on the street, are equipped with door locks, the handles of which project upwardly from the window sill inside the window of the associated door, and which have enlarged upper or knob-like ends for ease of gripping. Such handles are usually made of plastic or like material, and are constructed with a shank which extends downwardly through an opening provided in the window sill of the door. Such openings are usually smaller than the enlarged upper ends of the associated handles, but are sufficiently large to accommodate the insertion and reciprocal movement of the shanks of such handles. Such handles have an axially disposed threaded opening extending into their bases to provide for threaded attachment of the handle to an upwardly extending threaded rod or stem which constitutes the operating means for the lock of the associated door. In addition, such threaded handles and threaded rods or stems are capable of adjustment by turning the handle on or off of the threads of the rods or stems over a substantial length to permit the handles to be adjusted to a selected length and thus to have a predetermined upstanding height when the handle is in door-locking position. This length adjustment capability is desirable both from the standpoint of providing a sufficient upstanding gripping surface to permit the handle readily to be manually grasped and pulled upwardly to unlock the door, and also from the standpoint of causing the handle to assume a selected adjusted position at which the extent of its possible movement coincides with that which is required to effectively move the locking mechanism from an unlocked position to a locked position.

With the conventional handles now in general use, it is possible for an unauthorized person to insert between the edge of the window glass of the door and the surrounding framing portions of the automobile, a wire, having a properly sized hook formed by a bend at its lower end, and by a simple manipulation, to hook the end of the wire around the shank of the locking handle and below the enlarged upper end thereof, and then to lift the wire and the handle to unlock the door of the automobile. In fact, it is well known that thousands of automobiles which have their access doors locked have been entered in this manner with the result that the automobile or property contained therein has been stolen.

Applicant is aware of the fact that one prior art effort to deal with this problem has been the practice of replacing the conventional handles altogether with metal rodlike handles that have a uniform diameter throughout their length except for flattened opposite areas adjacent the top of the handle to assist in gripping. These replacement handles, however, are relatively expensive compared to the collars of this invention, and are difficult to grip for operating the lock. This difficulty is due to the small diameter that is essential in order that the handle may be inserted into the usual door sill openings provided for the door lock handles and at the same time avoid any enlargement at the top of the handle such as would provide an overhang like the handles now in conventional use. In other words, these prior art handles would be much the same as handles that might be made of the shank portion only of the conventional handles now in general use, or in other words, the same as conventional handles which have had their upper enlargements or knobs removed.

THE IMPROVEMENT OF THIS INVENTION

This invention provides an improved and simple solution to this problem which can be carried out by the use of an inexpensive collar of suitable material having an inside diameter large enough to accommodate the shank of the door locking handle with which it is associated but smaller than the diameter of the enlarged or knob-like upper end of such handle and an outside diameter at least as great as the diameter of the enlarged or knob-like upper end of such handle. In addition, such collar has a vertical height equal substantially to the distance between the upper surface of the door sill and the under surface of the enlarged or knob-like end of the handle when the length of the handle has been properly adjusted and the handle is in its lowermost or locked position.

By placing such collar around the shank of the handle when the handle is in operative position, the handle is converted from one having an enlarged portion under which a hook of wire or the like can be placed for lifting the handle, to one having a shank as large as the largest part of the handle and, therefore, one which is devoid of any portion under which a lifting hook may be placed. The collar may be placed in surrounding relationship with its associated handle by first removing the handle by turning to free it from its threaded engagement with the operating rod or stem of the lock, by inserting the shank of the removed handle through the opening in the collar, and by then replacing the handle and its associated collar by threading the same into the rod or stem of the lock.

When replacing the handle with its surrounding collar, the handle should first be turned on to the threaded rod or stem to cause the handle to be attached to the locking mechanism and thereafter should be further turned to being the handle to theposition at which the collar completely occupies the space between the underside of the enlarged head on the handle and the sill of the associated door when the handle is depressed to locked-door position. In this way, the overhang that otherwise would be presented by the enlarged upper end of the handle is completely eliminated and, correspondingly, the capability of hooking a wire under the handle head also has been completely eliminated. In this way, the lock is made substantially thief-proof insofar as the use of a hooked wire inserted between the window and window frame is concerned.

A SPECIFIC EXAMPLE

This invention may be more readily understood by referring to the accompanying drawings, which show one preferred embodiment of the invention, and in which FIG. 1 is an elevational view of a portion of an automobile door partly broken away to show the relationship of the collar and handle and the door locking mechanism of this invention;

and

Figure 4:
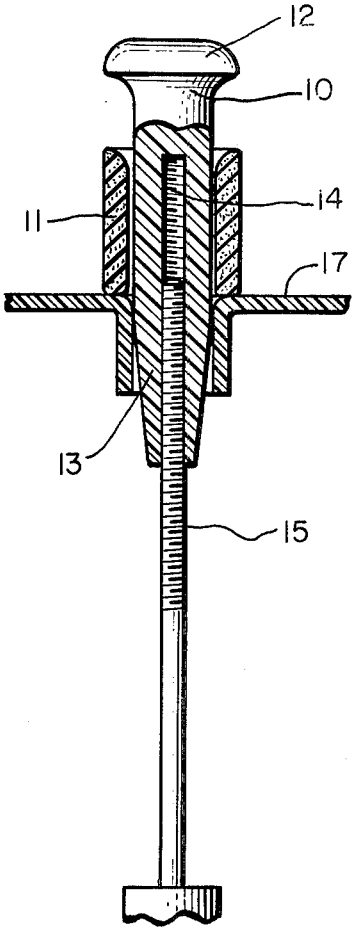

FIG. 4 is an elevational view partly in cross-section showing the handle and collar of this invention in unlocked position after the operator's grip has been released and the dollar has dropped down to engage the sill.

Figure 1:
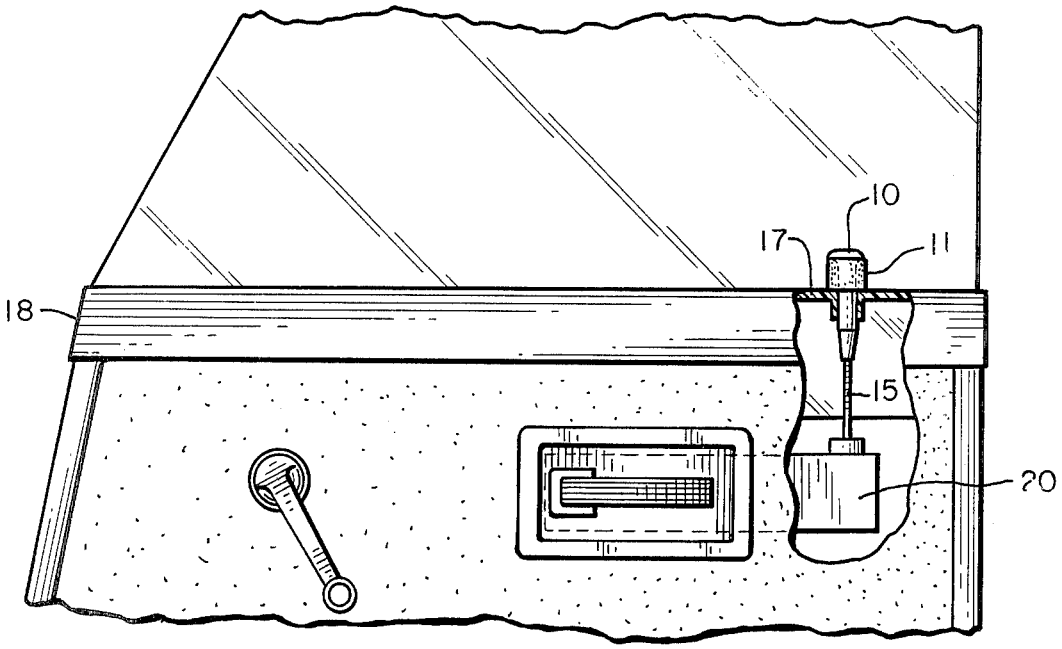
Figure 2:
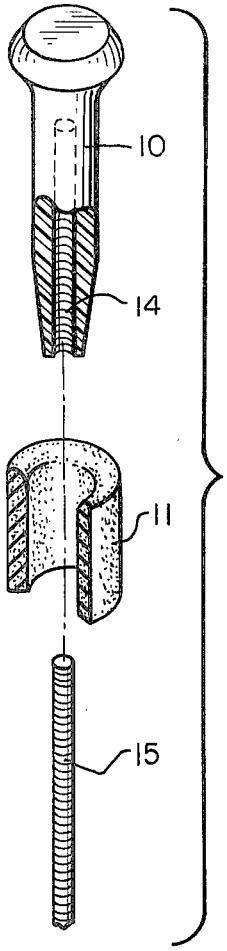
FIG. 2 is an exploded perspective view of a handle, collar and associated door locking rod or stem of this invention.
Figure 3:
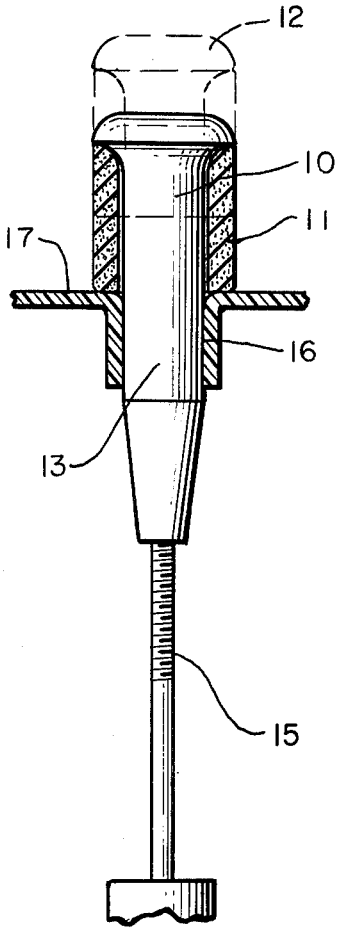
FIG. 3 is an elevational view partly in cross-section showing the handle, collar and locking stem of this invention in locked position and, in phantom, showing the handle and collar when lifted to unlock the door.

By referring to the drawings, it will be noted that the form of the invention here shown by way of illustration comprises a door-locking handle 10 of usual construction in combination witha collar 11. The handle 10 is of the usual construction now commonly employed on automobiles and has a head 12 and shank 13. The shank is provided with an axial opening extending upwardly from its bottom surface and provided with internal threads 14 adapted for screw-threaded attachment to a rod or stem 15 which has matching threads. The extent of the threaded portions of the handle and rod or stem, respectively, is sufficient to permit the handle to be inserted through the opening 16 in the sill 17 of the automobile door 18 and to be threaded onto the rod or stem 15 and thereafter adjusted by further turning to cause the enlarged top of the handle to be seated in engagement with the upper annular surface of the collar 11 when the handle is depressed and the rod or stem is in the position which locks the door. The door lock is shown in outline at 20 in FIG. 1.

It can be seen that collars of the type here referred to can be readily and cheaply produced and supplied to automobile owners at a low cost. Also, it is apparent that they may be applied and put in use through the simple act of unscrewing each door lock handle and applying the collars to the shank of each handle and then again attaching the handles by turning them onto their associated rods or stems, respectively. Thereafter by a simple adjustment effected by additional turning of the handles, the handles are brought to a position, when in locked-door position, at which the space underlying the head of the handle is completely occupied by the associated collar. In some cases it may be found that the door sill may slightly curve and thus not present a flat horizontal surface for contact with the under annular surface of the collar. In such case, it is preferable to use a rubber collar which is capable of being compressed somewhat and to adjust the handle on the rod or stem of the lock so as to exert a compressing pressure on the collar when the handle is in door-locking position. In this way, one can be assured that no space will exist under the collar into which a wire hook or like device may be inserted to lift the locking handle.

Also, it will be noted that the upper annular surface of the collar is formed to conform to the under surface of the overhanging portion of the enlarged head or knob on the upper end of the handle. This feature also assures the avoidance of any space between the handle head and collar into which a wire hook or the like may be inserted.

I claim:

1. In combination with a handle for an automobile door lock of the type having a shank extending downwardly into an opening in the window sill of an automobile door, an enlarged upper end or knob of diameter larger than said window sill opening, and means establishing an adjustable screw threaded attachment to a rod or stem serving as the operating means for said door lock, a collar of suitable material having an outside diameter at least equal to the diameter of said enlarged end or knob and an inside diameter which slidably accommodates said shank, said collar surrounding said shank, and having an upper annular surface shaped to conform to the underside of said enlargement or knob and substantially filling the space between the underside of said handle and said sill when said handle is adjusted and depressed into door-locking position, said collar being freely movable with respect to said sill whereby it can be gripped by the thumb and finger and lifted and thus impart a lifting movement to said handle and yet remain free to drop downwardly with respect to the lifted handle when the manual grip is released to allow the collar to fall while surrounding the shank of said handle until the collar comes to rest on said sill, said collar thus serving as a convenient means for manually unlocking the associated door and at the same time serving as a means for converting said handle when locked to one that cannot be engaged by a hooked wire extended into said automobile through the space surrounding the window, for lifting said handle and unlocking the automobile door.

2. The combination described in claim 1 further characterized in that said collar is made of compressable material whereby it may be compressed somewhat in door locking position of said handle between the under surface of the enlarged upper end or knob of said handle and said door sill to affect a close contact between the bottom annular surface of said collar and said door sill.

* * * * *